United States Patent [19]

Andersen

[11] 4,404,833

[45] Sep. 20, 1983

[54] DEVICE FOR STRAIGHTENING OF PIPES

[76] Inventor: Torkil K. Andersen, Jovavej 25, Kolding, Denmark

[21] Appl. No.: 305,632

[22] PCT Filed: Jan. 15, 1981

[86] PCT No.: PCT/DK81/00005

§ 371 Date: Sep. 21, 1981

§ 102(e) Date: Sep. 21, 1981

[87] PCT Pub. No.: WO81/02120

PCT Pub. Date: Aug. 6, 1981

[30] Foreign Application Priority Data

Jan. 21, 1980 [DK] Denmark ..... 232/80

[51] Int. Cl.[3] ..... B21D 3/00

[52] U.S. Cl. ..... 72/216; 72/388; 72/453.15; 72/457

[58] Field of Search ..... 72/388, 387, 457, 458, 72/310, 318, 323, 214, 216, 215, 217, 453.15

[56] References Cited

U.S. PATENT DOCUMENTS

| | | | |
|---|---|---|---|
| 1,268,844 | 6/1918 | Holinger | 72/387 |
| 3,353,393 | 11/1967 | Goodwill | 72/392 |
| 3,584,493 | 6/1971 | Crees | 72/216 |
| 3,765,219 | 10/1973 | Easom | 72/389 |
| 3,786,668 | 1/1974 | Crees | 72/388 |
| 3,861,186 | 1/1975 | Wigner | 72/217 |
| 4,026,138 | 5/1977 | Miller | 72/388 |

*Primary Examiner*—Gene Crosby

*Attorney, Agent, or Firm*—Antonelli, Terry & Wands

[57] ABSTRACT

For straightening of bent pipes a device with a base in two parts provided for spanning the bent pipe on one longitudinal side of the bend of the pipe. One base is connected to one end of a tie bar, which is pivotally fastened at the other end to a piston rod in a working cylinder. The working cylinder is pivotally fastened to a corner of a triangular straightener, another corner being pivotally fastened to one part of the other base, and the side opposite this corner bearing a thrust block or roller, which presses against the other longitudinal side of the bend of the pipe.

7 Claims, 1 Drawing Figure

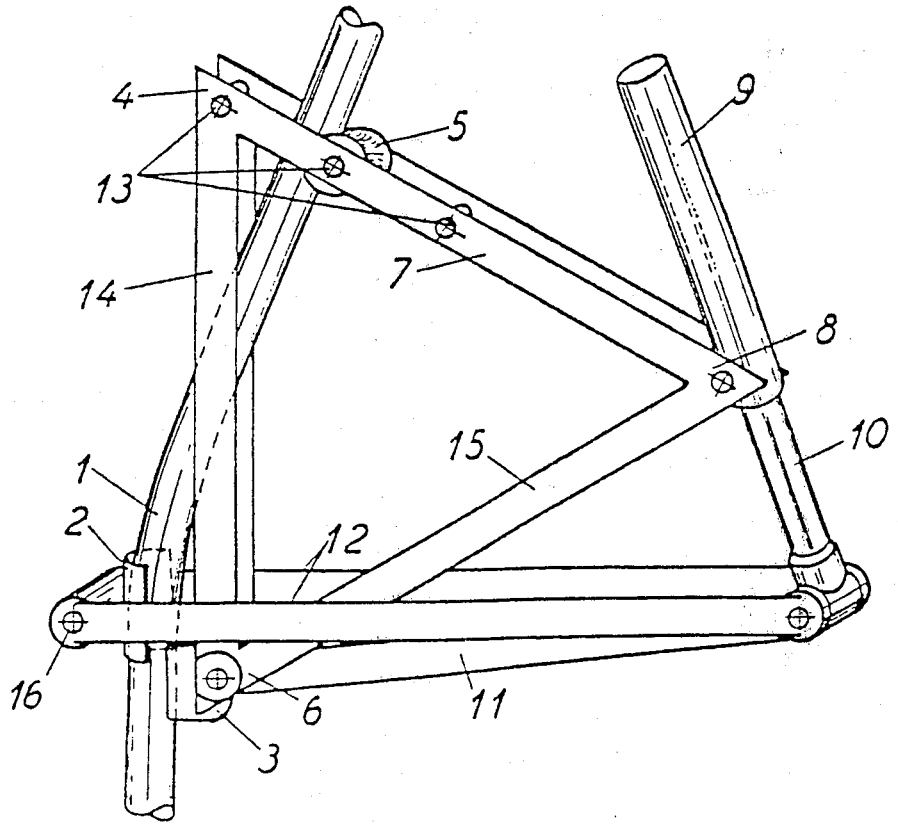
4
5
9
13
7
14
8
15
10
1
2
12
16
6
11
3

DEVICE FOR STRAIGHTENING OF PIPES

The invention relates to a device for straightening of pipes, especially for straightening of bent, tubular road sign posts.

For straightening of bent pipes a device is used that comprises two bases placed on each side of the bend on its outside. This device can not be used for straightening of bent road sign posts, where the bend is near the surface of the earth.

The purpose of this invention is to present a device to meet this disadvantage.

This is achieved when the device comprises a base in two parts to span the bent pipe on one side of its bend, which base is connected to one end of at least one bar, the other end of which is pivotally fastened to a piston rod in a working cylinder, which is pivotally fastened to a corner of a triangular straightener, another corner being pivotally fastened to one part of the base, and the side opposite this corner being the basis for a thrust block or roller arranged in a way that allows this to press against the other side of the bend of the pipe. Thus, the device can be easily placed on a pipe that is to be straightened. The base is placed immediately under the bending, and thus bends close to the earth can be straightened.

The device can be characterized in that the bars are pivotally fastened on opposite sides of pipe gripping tight-fitting thrust pads of the base, and that the bars are connected to the piston rod at the same point, the lengths of the bars being fitted to allow the thrust pads to squeeze the pipe, as the bars form an acute angle to each other. This embodiment is especially appropriate, as the base in two parts automatically tightens round the pipe when activating the working cylinder of the device.

Finally, the device can be characterized in that the thrust block or roller can be fastened to the side of the triangular straightener that is opposite the corner where the triangular straightener is connected to the base at different distances from the third corner of the triangular straightener. By this means, heavily bent pipes can be straightened, even if a working cylinder with a limited length of stroke is used.

The invention will be further explained with reference to the drawing, showing an embodiment according to the invention, seen from the side.

The device consists of a triangular straightener frame 7, 14, 15, to the lower corner 6 of which a thrust pad 3 is pivotally fastened to fit tightly against a pipe 1 at the inside of the bend. At the other corner 8, a pneumatic or hydraulic working cylinder 9 is pivotally fastened, the piston rod 10 of which is pivotally fastened to two sets of bars 11 and 12. One set of bars 11 are at the other end fastened pivotally to the corner 6 and the base 3. To the other set 12, another thrust pad 2 is mounted, pivotally too, at the other end thereof, by connector 16 to fit tightly against the pipe 1 at the outside of the bending. Finally, a pressure element in the form of a thrust roller 5 is mounted on one side 7 of the triangular straightener. This thrust roller 5 can be moved between several positions 13 at different distances from the corner 4.

The device functions in the following way. The base 2, 3 in two parts is placed round the pipe 1 immediately below the bend so that the thrust roller 5 abuts the pipe 1 above and at the inside of the bending. When activating the working cylinder 9, the thrust pads 2 and 3 are pressed firmly round the pipe 1, whereupon the triangular straightener turns about the corner 6, the thrust roller 5 transmitting the straightening power from the working cylinder 9 to the pipe, which is then straightened, as the necessary reaction against the pipe 1 is transmitted through the thrust pad 2. It will be appreciated from the foregoing, with reference to the drawing, that the reaction force at thrust pad 2 acts to press same in a direction away from the straightener (leftward in the drawing) so that bars 12, with interconnecting member 16, form a tie structure for holding thrust pad 2 against this force. On the other hand, bars 11, which are pivotally connected to thrust pad 3 and the straightener, simply act as a thrust structure transmitting the straightening force of the working cylinder 9 in a manner which, as indicated, causes thrust pad 3 to be pressed against the pipe 1.

I claim:

1. Device for straightening of bent, tubular road sign posts, characterized in that the device comprises a base (2, 3) in two parts to span a bent pipe (1) on one side of its bent portion, which base (2, 3) is connected to one end of at least one bar (11), the other end of which is pivotally fastened to a piston rod (10) in a working cylinder (9), which is pivotally fastened to a corner (8) of a triangular straightener (7, 14, 15), another corner (6) being pivotally fastened to one part of the base (3), and the side (7) opposite this corner (6) bearing a thrust roller (5) arranged to press against the other side of the bent portion of the pipe (1).

2. Device for straightening of pipes according to claim 1, and where two bars are placed on the base, characterized in that the bars (11, 12) are pivotally fastened on opposite sides of pipe gripping tight-fitting thrust pads (2, 3) forming the base, and that the bars (11, 12) are connected to the piston rod (10) at the same point, the lengths of the bars (11, 12) allowing the thrust pads (2, 3) to squeeze the pipe (1) upon actuation of the working cylinder.

3. Device according to claim 1 or 2, characterized in that the thrust roller (5) can be fastened to the side (7) of the triangular straightener (7, 14, 15) that is opposite the corner (6) where the triangular straightener (7, 14, 15) is connected to the base (3) at different distances from a third corner (4) of the triangular straightener (7, 14, 15).

4. A device for straightening of a bend in a pipe, such as an accidentally bent road sign post, comprising a straightener frame and a pair of base members for mounting, when in use, against the pipe at one longitudinal side of the bend thereof, a first of said base members being constructed and arranged for placement against the pipe at a position spaced longitudinally from and at an outer side of the bend, said first base member being mounted at an end of a tie structure extending laterally with respect to the pipe, said second base member being mounted at an end of a thrust structure extending laterally with respect to the pipe and connected to the tie structure by a pivot spaced at distances from said base members which are several times the diameter of the pipe, one of said base members being pivotally connected with a portion of said straightener frame that is constructed and arranged to extend from said base, in use, longitudinally along the pipe beyond an opposite end of the bend relative to the second base member to a location at which is mounted a pressure element for abutting the pipe beyond the bend at the inner side thereof, and a force exerting means engaged between said straightener frame and said tie structure for exerting straightening forces acting to press said pressure element against said pipe in a direction thrusting the pipe against the first base member for straightening the bend.

5. A device as claimed in claim 4, wherein the force exerting means is engaged with said tie structure by means of said pivot.

6. A device as claimed in either of claims 4 or 5, wherein said straightener frame is a triangular structure having a first corner pivoted to said second base member, a second corner pivoted to said force exerting means, and third corner in the vicinity of said pressure element.

7. A device as claimed in claim 6, wherein said triangular structure is constructed to permit said pressure element to be mounted at any selected one of a plurality of positions along a side thereof which is opposite to said first corner.

* * * * *